US005437347A

United States Patent [19]

Biewald et al.

[11] Patent Number: 5,437,347

[45] Date of Patent: Aug. 1, 1995

[54] CABLE TENSIONING DEVICE FOR ELEVATORS

[75] Inventors: Joachim Biewald, Winnenden/Degenhof; Volker Scheub, Waiblingen; Helge Holler, Pforzheim; Karl Fenkl, Stuttgart; Stefan Hugel, Schwaikheim; Wolfgang Barth, Bietigheim-Bissingen; Hans-Georg Grell, Oestrich; Martin Grosser, Böblingen; Hermann Moll, Weissach im Tal; Horst Pollmann, Weil der Stadt; Peter Schneider, Ditzingen, all of Germany

[73] Assignee: C. Haushahn GmbH & Co., Stuttgart, Germany

[21] Appl. No.: 242,092

[22] Filed: May 12, 1994

Related U.S. Application Data

[62] Division of Ser. No. 14,310, Feb. 5, 1993, Pat. No. 5,398,781.

[30] Foreign Application Priority Data

Feb. 5, 1992 [DE] Germany ..... 9201374 U

[51] Int. Cl.[6] ..... B66B 11/04

[52] U.S. Cl. ..... 187/264; 187/266

[58] Field of Search ..... 187/20, 22, 23, 26, 187/264, 266; 254/900, 335

[56] References Cited

U.S. PATENT DOCUMENTS 988,016 3/1911 Neenan ..... 187/22
1,132,769 3/1915 Gale, Sr. ..... 187/22

*Primary Examiner*—Kenneth W. Noland
*Attorney, Agent, or Firm*—Anderson Kill Olick & Oshinsky

[57] ABSTRACT

The invention deals with a cable tensioning system for elevators with separate drive cable and support cable lines 10, 11, which both engage at an elevator cabin 12 and also at a counterweight 13, characterized in that the cable tensioning system comprises a rocker 20 configured as a lever and supported at the counterweight 13 or the elevator cad 12, at which rocker the support cable 11 and the drive cable 10 are fastened to be spaced from each other, that the spacing ratio a: b of the attachment points 31, 32 of the cable lines 10, 12 at the rocker 20 from the support point 21 of the rocker 20 at the counterweight 13 or the elevator cab 12 define the cable tension or pull ratio required for the driving capacity.

4 Claims, 10 Drawing Sheets

CABLE TENSIONING DEVICE FOR ELEVATORS

This is a divisional application of Ser. No. 08/014,310, filed Feb. 5, 1993 now U.S. Pat. No. 5,398,781.

BACKGROUND OF THE INVENTION

1. Field of the Invention

The invention deals with a cable tensioning device for elevators with drive cable and support cable lines separated according to the driving or support functions which both engage at an elevator cabin as well as at a counterweight.

2. Description of the Prior Art

In conventional elevator installations, where the support cable line and the drive cable line or motive cable line are separate, the drive cable is driven by a drive disk provided between the elevator cabin and the counterweight and is reversed or redirected by one or more reversing rollers. Meanwhile the support cable merely fulfills the carrying or support function and is not powered or driven. In the operation of elevator installations, especially those installed in high-rise buildings, in which the cable lengths of the power cable can amount to several hundred meters, considerable cable elongations or extensions occur in the drive cable. This can have a disadvantageous effect upon the force conditions existing between the drive disk and drive cable, the so-called cable tension or pull ratio.

SUMMARY OF THE INVENTION

In order to maintain a specific or defined cable line ratio or relationship in spite of the occurring cable elongation, a cable tensioning system has to be provided, which acts either upon the drive cable directly or upon a roller reversing same and tensions the drive cable as a function of the cable elongations.

Therefore, it is the task of the invention to provide a cable tensioning system for elevators in such a way that it can compensate for cable elongation in a closed cable system that occurs when operating the elevator. Consequently, the cable forces are kept as low as possible and the cable tension or cable pull ratio required for maintaining the driving ability can be assured.

This task is solved in the invention by a cable tensioning system stated in the preamble of claim 1 by features indicated in its characteristic portion.

Accordingly, the cable tensioning system comprises a rocker configured as a lever supported at the counterweight or the elevator cab, to which the drive cable and the support cable are fastened in such a way spaced from each other, that the spacing ratio a:b of the attachment points of these cables at the rocker referred to the support point or the fulcrum of the rocker at the counterweight or the elevator cab defines the cable pull or force ratio required for the driving ability.

Hereby the driving ability is advantageously no longer directly determined by the weight of an elevator cabin and counterweight, which enables to use lighter elevator cabins. Because the rocker of the cable tensioning system is supported at the counterweight or the elevator cabin, the existing counterweight is used for cable tensioning and for cable length compensation.

If the drive disk of the driving mechanism is located at the top, it is preferred that the rocker be configured as a two-sided lever, wherein the support point of the rocker at the counterweight then lies between the attachment points of drive cable line and support cable line to the rocker, and that both cable falls or lines are directed upwards.

If, on the other hand, the drive disk of the driving mechanism is located at the bottom, it is preferable that the rocker be configured in the shape of a one-sided lever, wherein the support point of the rocker at the counterweight or the elevator cabin is located outside of the attachment points of both cable lines at the rocker and that the drive cable is directed downwards.

The rocker can be configured as a simple lever or as is preferred in circular segment-shaped sections, wherein the support cable line and drive cable line are respectively directed over peripheral circular arcs of the circular segment sections, whose radii correspond respectively to the lever arms a and b of the rocker.

For controlling undesirable rotary movements of the rocker because of operating interruptions or faults or counterweight hunting or bouncing, a damping element is provided between the support point and the rocker, which dampens the undesirable rotary movements of the rocker.

So that the lever ratio of the rocker can be adjusted at the utilization site of the elevator installation, it is preferred that the length of the lever arms a and b of the rocker be adjustable.

The cable tension system in the invention permits location of the driving mechanism at any level next to the shaft or directly below or above same without the necessity of running the entire number of cables through the elevator shaft; this in connection with the closed cable system and the functional separation of the cables according to drive- and support functions.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF PREFERRED EMBODIMENTS

Figure 1:
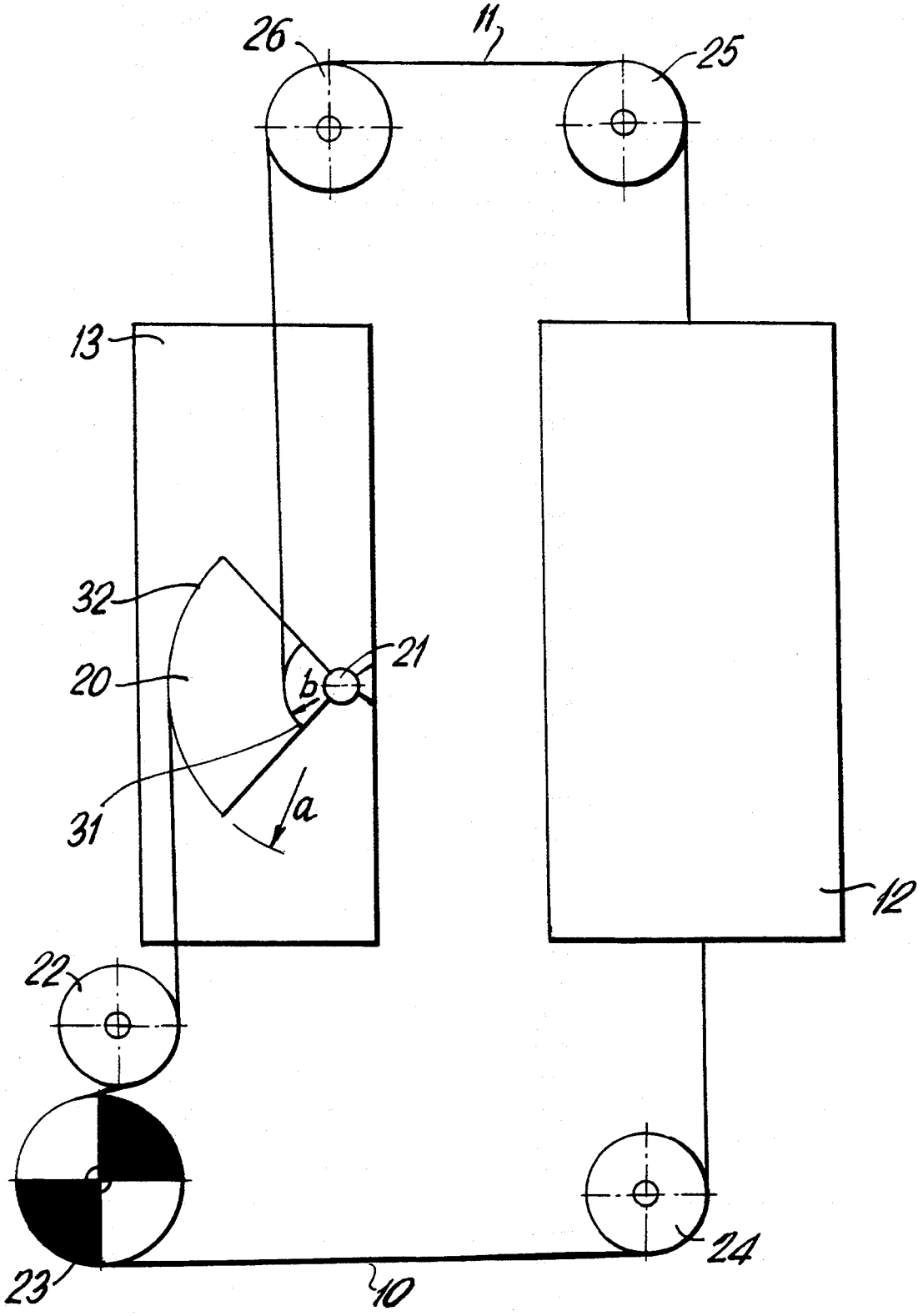
FIG. 1 is a diagram of a first embodiment of the cable tensioning system of the invention.

In the first version shown in FIG. 1 a support cable 11 fastened to the upper portion of an elevator cabin 12 is directed over reversing rollers 25 and 26 to a counter or balancing weight 13, where coming from above it is attached to a rocker 20 of the cable tension system. The driving or power cable 110 is attached to the bottom portion of the elevator cabin 12 and is directed from below to the counterweight 13 over a reversing roller 24, a drive disk 23 and an additional reversing roller 22. It is seen that the drive cable 10 is fastened to the rocker 20 at an attachment point 32 and the support cable 11 is fastened to the rocker 20 at an attachment point 31. The rocker 20 is supported at the counterweight 13 by a bearing or support point 21.

The support point 21 of the rocker 20 is located externally of the attachment points 32 and 31 of the power cable 10 and the support cable 11, respectively, so that the rocker 20 acts as a one-sided lever.

The rocker 20 has the shape of two concentric circular segments, wherein the radius of the circular arc of the smaller segment corresponds to the lever arm b of the articulation point 31 at the rocker 20 and the radius of the larger segment corresponds to the lever arm a of the attachment point 32 of the power drive cable 10 at the rocker 20. In this way the drive cable 10 is conducted over a circular arc with a radius a and the support cable 11 over a circular arc with a radius b in such a way, that the attachment point 32 and 31 respectively of the support cable 11 and the drive cable 10 remain constant as far as their vertical orientation is concerned and thus the drive cable 10 always travels vertically between its reversing roller 22 and its point of engagement at the rocker 20 and the support cable 11 always travels vertically between its reversing roller 26 and its attachment point 31 at the rocker 20.

Figure 1A:
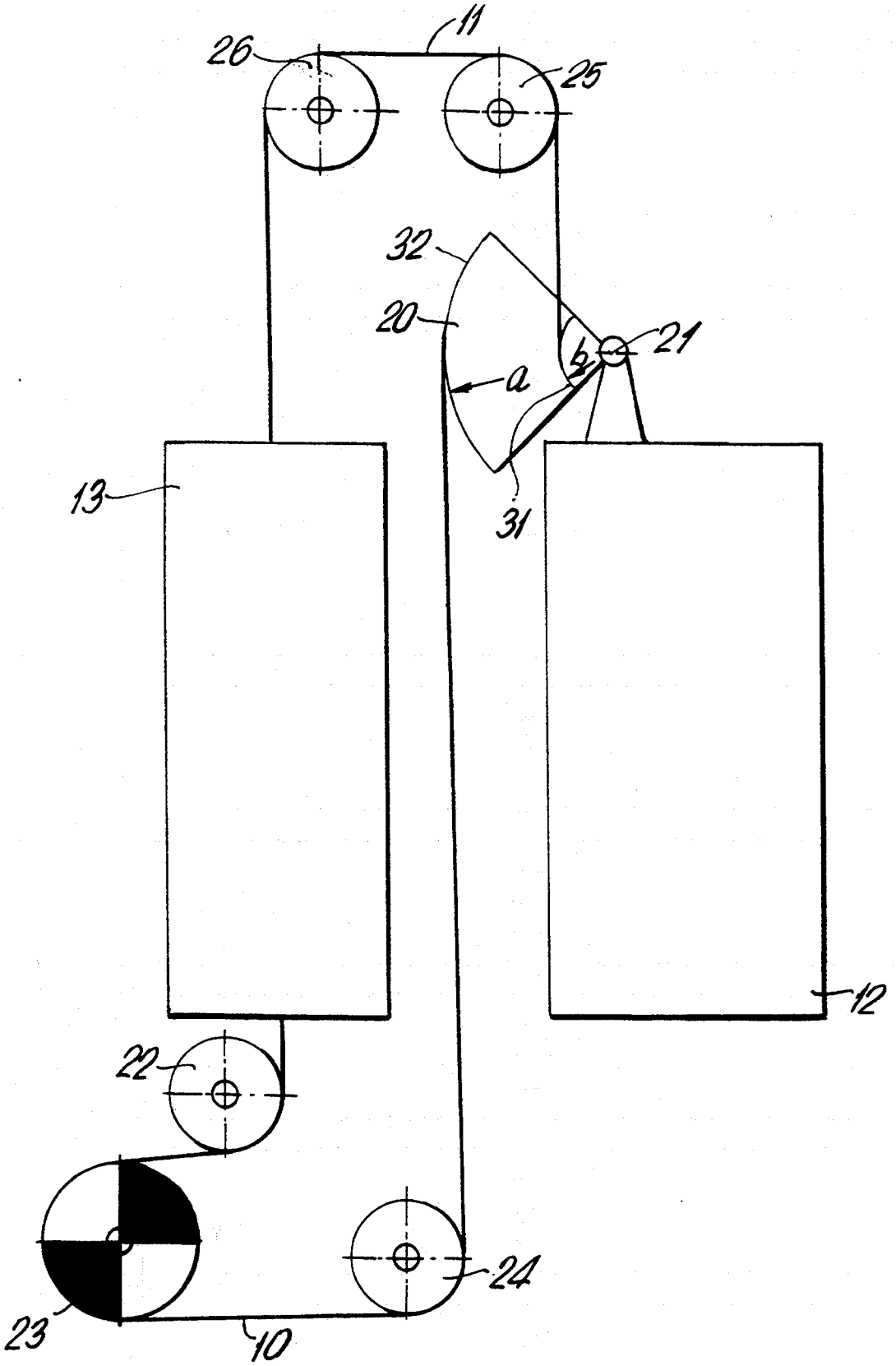
FIG. 1*a* is a diagram of a second embodiment of the cable tensioning system of the invention.

The embodiment shown in FIG. 1*a* is similar to that of FIG. 1, with the exception that the support point is attached to the elevator cabin 12. In this way, the drive cable 10 always travels vertically between its reversing roller 24 and its point of engagement at the rocker 20, and the support cable 11 always travels vertically between its reversing roller 25 and its attachment point 31 at the rocker 20.

Figure 2:
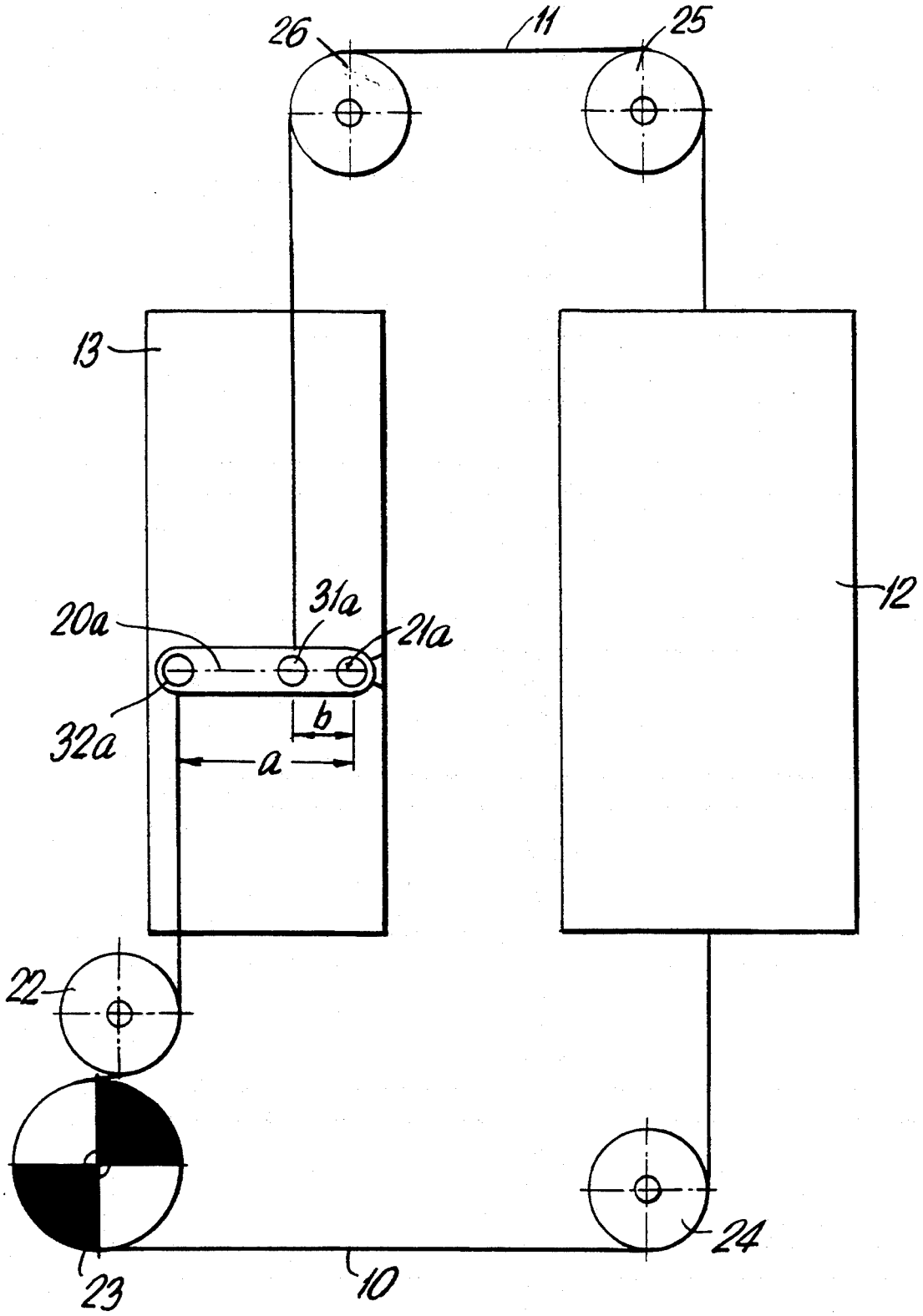
FIG. 2 is a diagram of a third embodiment of the cable tensioning system of the invention.

The embodiment shown in FIG. 2 is identical to that shown in FIG. 1 with the exception of the rocker 20*a* design. The rocker in FIG. 2 is shaped like a cantilevered beam. However, the support or bearing point 21*a* lies externally of the attachment points 31*a* and 32*a* of the support cable 11 and the drive cable 10, respectively, just as in the embodiment form in FIG. 1. The spacings a and b of the attachment points 32*a* of the drive cable 10 and 31 of the support cable 11, respectively, at the rocker 20*a* define exactly, as is the case in the embodiment in FIG. 1, the cable pull or tension ratio required at the counterweight for maintaining the driving capacity. The rocker 20*a* transmits a force component defined by the lever ratio a:b from the attachment point 32*a* to the drive cable 10, which component acts a load dependent cable tension force or pull force for the drive cable 10.

Figure 2A:
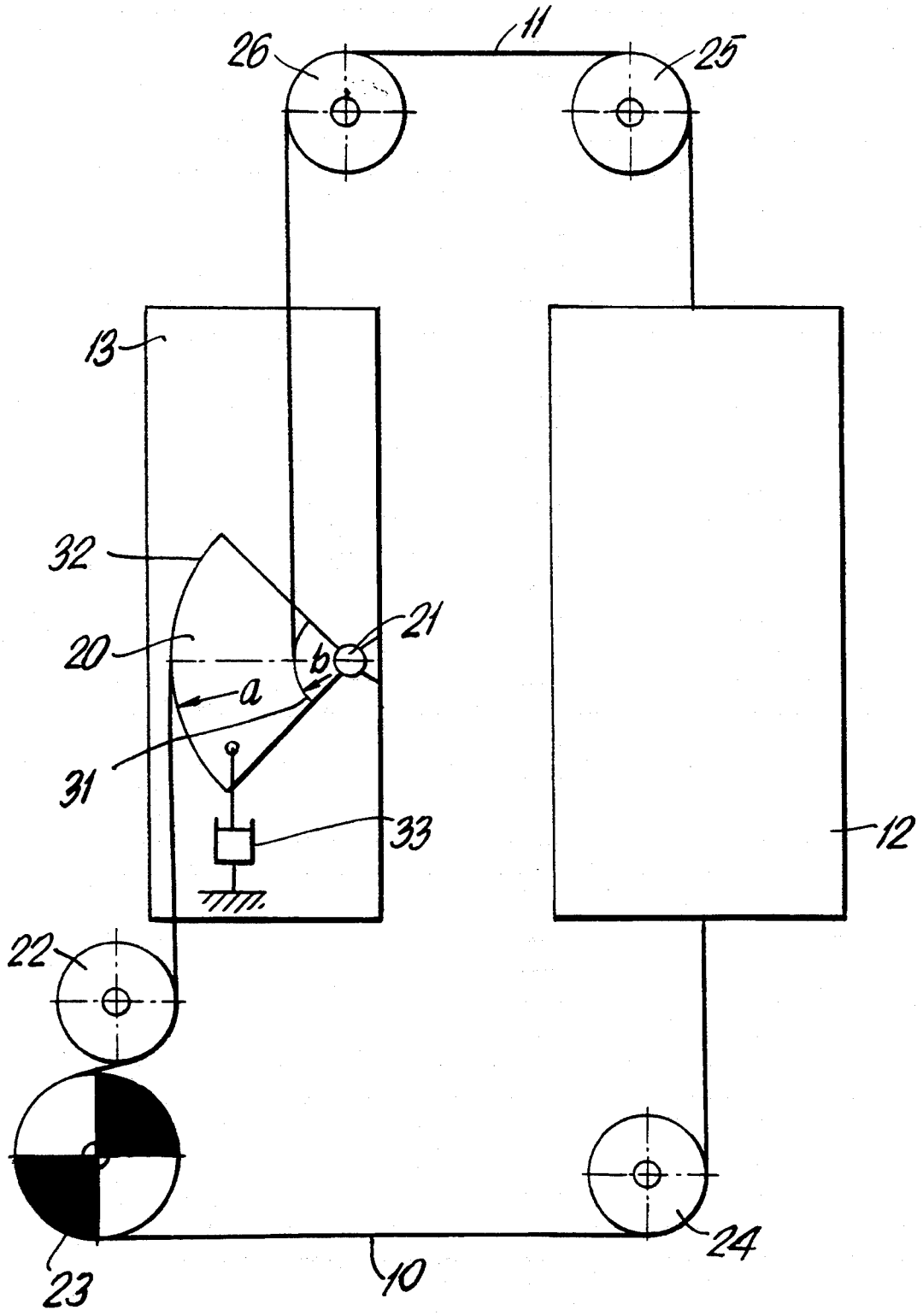
FIG. 2*a* is a diagram of a fourth embodiment of the cable tensioning system of the invention.
Figure 2B:
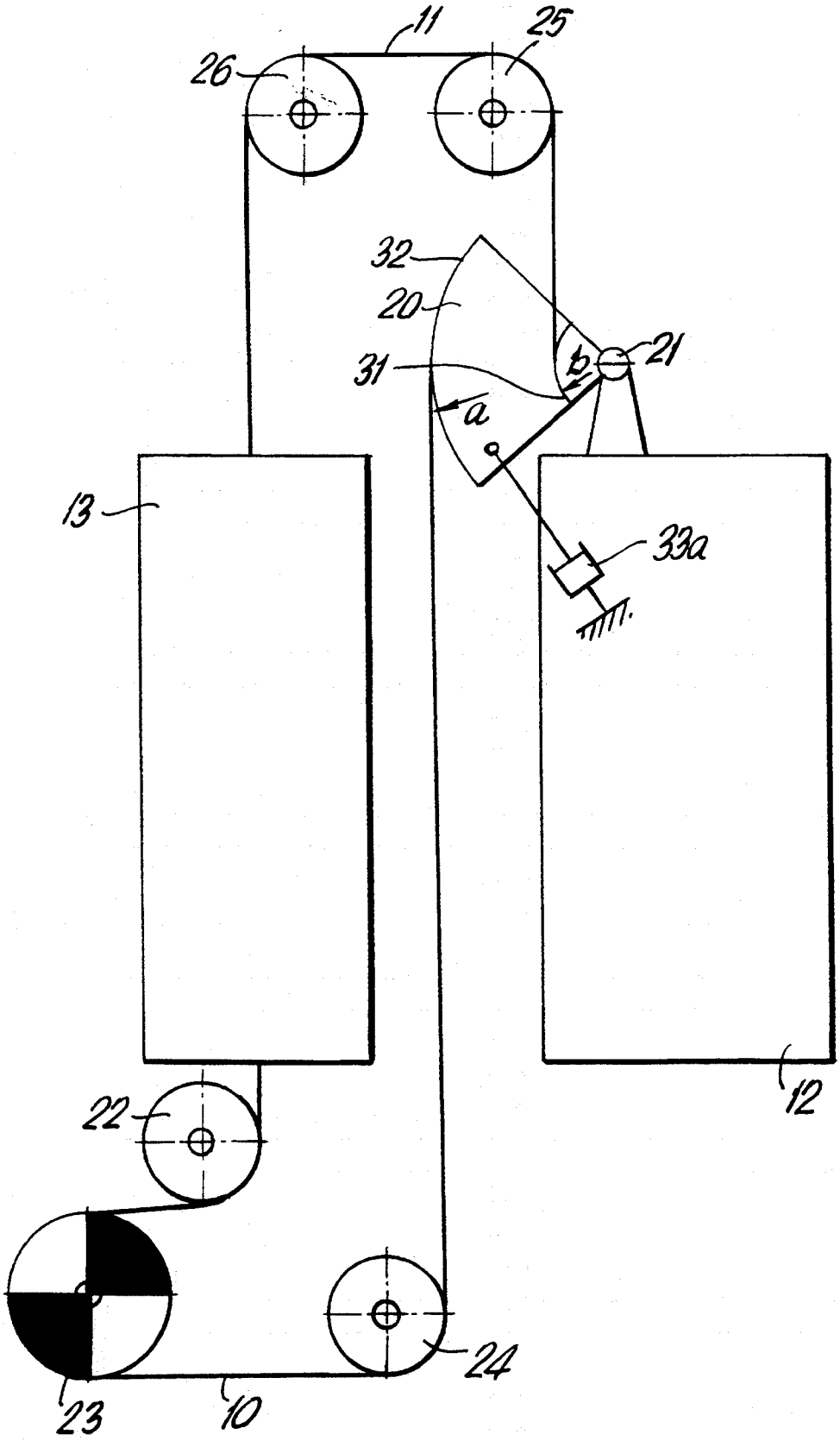
FIG. 2*b* is a diagram of a fifth embodiment of the cable tensioning system of the invention.

The embodiments shown in FIGS. 2*a* and 2*b* are similar to those of FIGS. 1 and 1*a*, respectively, but show additionally damping elements 33 and 33*a* of the rockers 20 and 20*a*, respectively.

Figure 3:
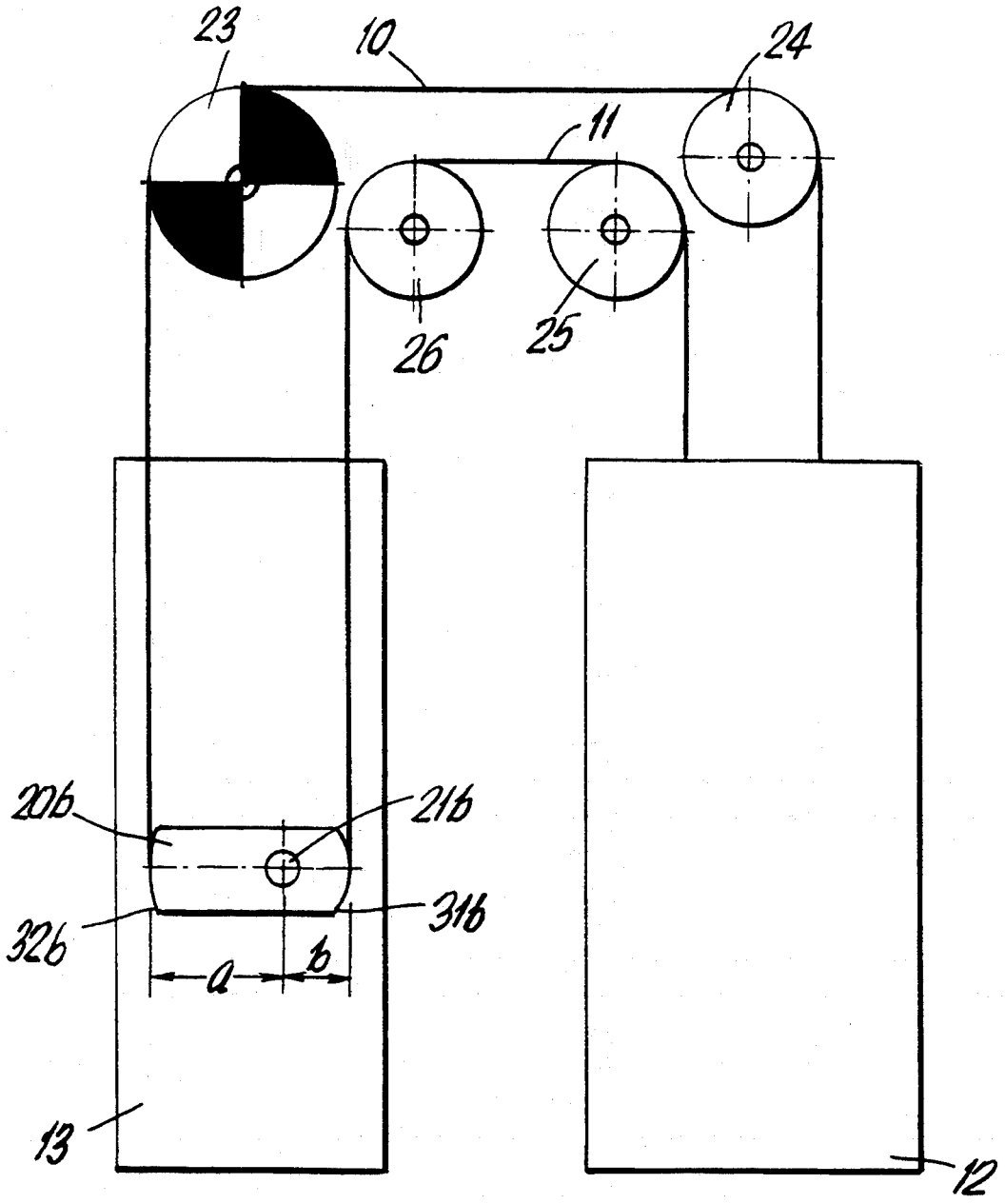
FIG. 3 is a diagram of a sixth embodiment of the cable tensioning system of the invention.

In the embodiment shown in FIG. 3 the driving or power mechanism is located at the top, unlike the embodiments shown in FIGS. 1 and 2, this being indicated by the location of the drive disk 23. In this version the drive cable 10 and the support cable 11 are drawn off the rocker 20*b* towards the top. The rocker 20*b* is configured as a two-sided lever, wherein the bearing or support point 21*b* of the rocker 20*b* is located between the attachment points 32*b* and 31*b* of the drive cable 10 and the support cable 11, respectively. Proceeding from these attachment points 32*b* and 31*b* the drive cable 10 and the support cable 11 are respectively directed over circular arc-shaped peripheral front faces of the rocker 20, whose radii correspond respectively to the lever arms a and b of the rocker 20*b*. Thus the rocker 20*b* has the advantage equally so as the rocker 20*b* in the first embodiment shown in FIG. 1, that the cable articulation point remains oriented in the vertical direction also if angular changes at the rocker occur.

Figure 3A:
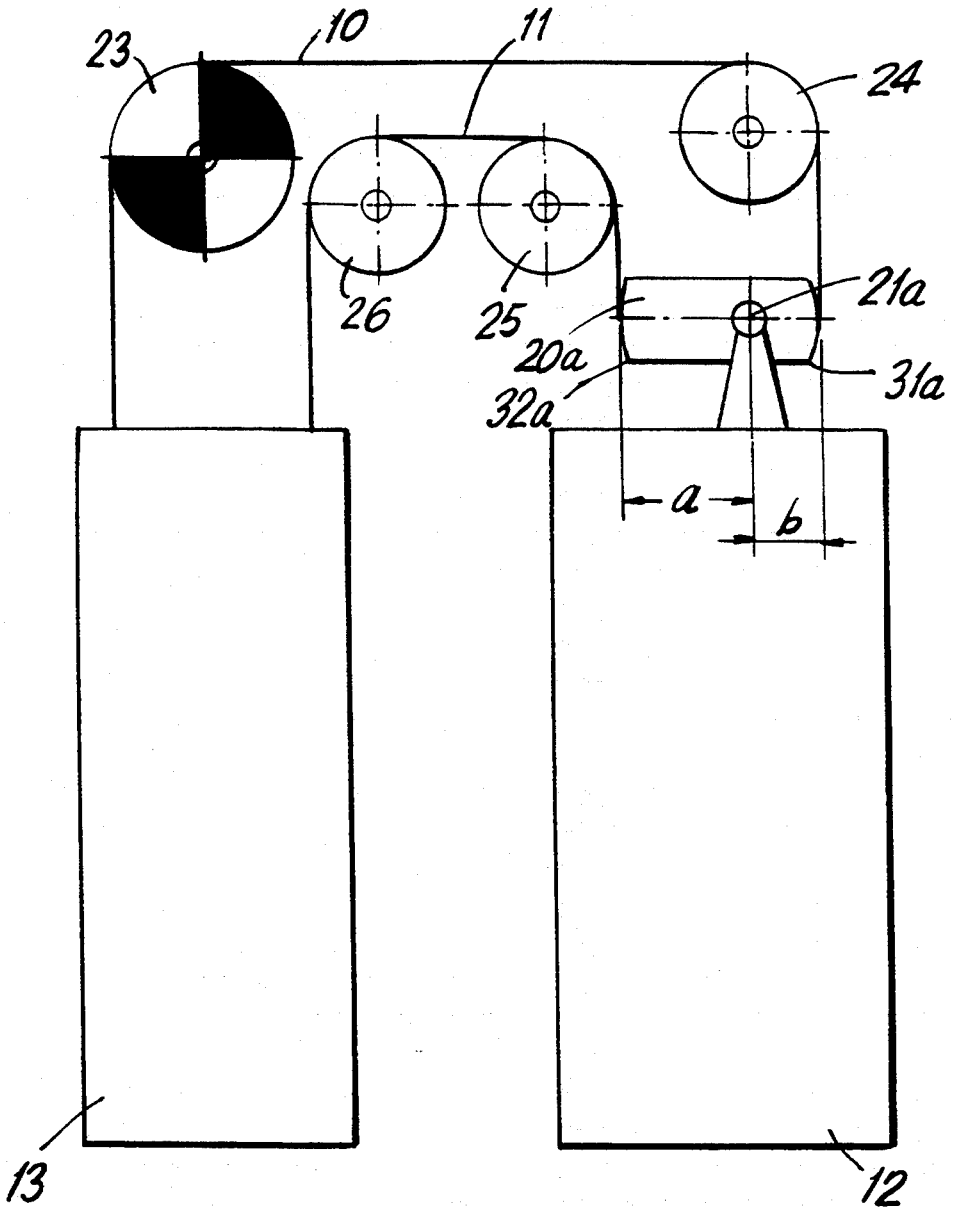
FIG. 3*a* is a diagram of a seventh embodiment of the cable tensioning system of the invention.

FIG. 3*a* shows an embodiment similar to that of FIG. 3 with the exception that the support point is attached to the elevator cabin 12.

Figure 4:
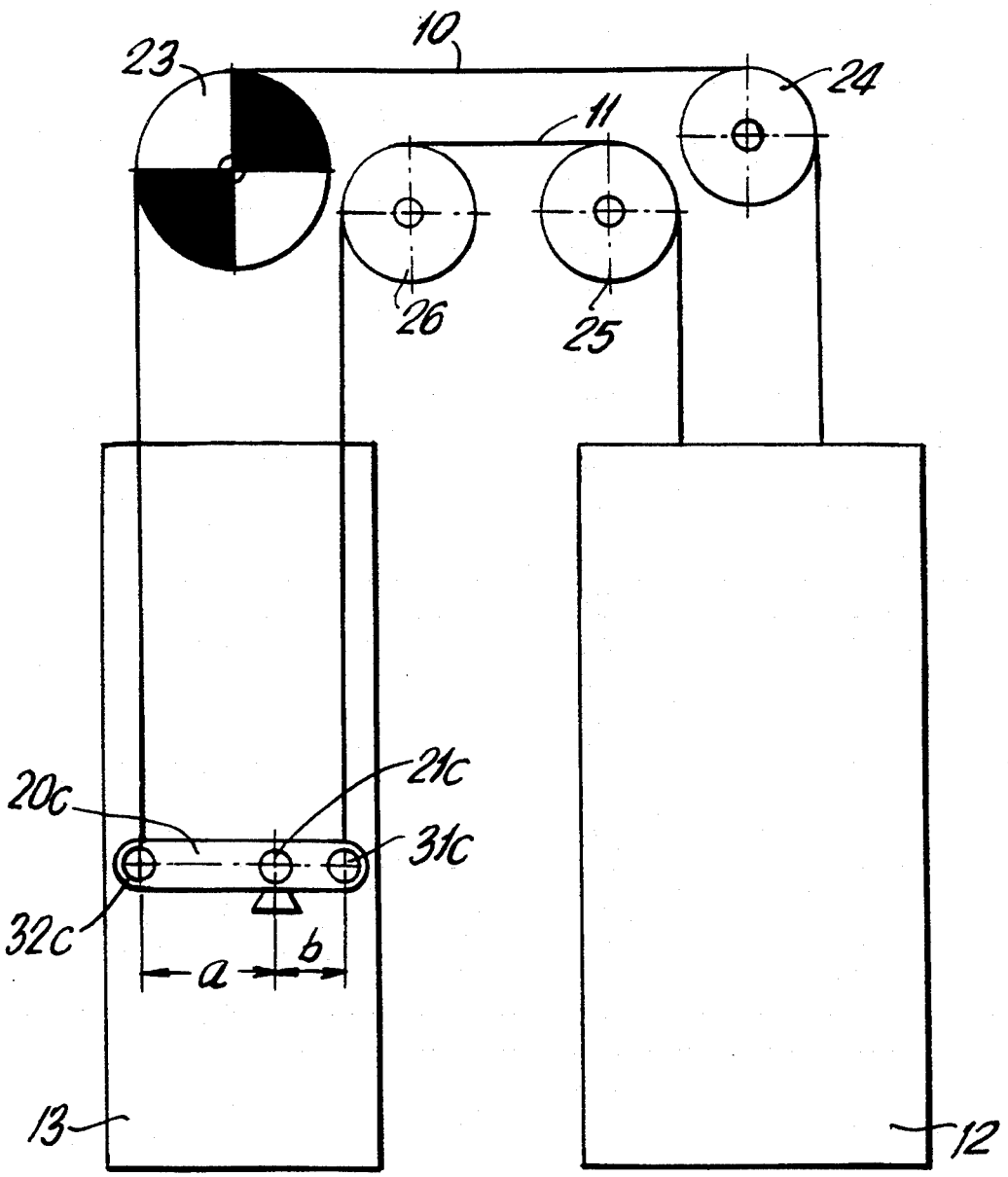
FIG. 4 shows an eighth embodiment of the inventive cable tensioning system.

The embodiment shown in FIG. 4 corresponds, as far as the cable travel and the top position of the driving mechanism as evidenced by the drive disk 23 is concerned, to the embodiment depicted in FIG. 3. Only the design of the rocker 20*c* differs. It has the shape of scale beam without the previously mentioned circular arc-shaped peripheral sections.

Figure 4A:
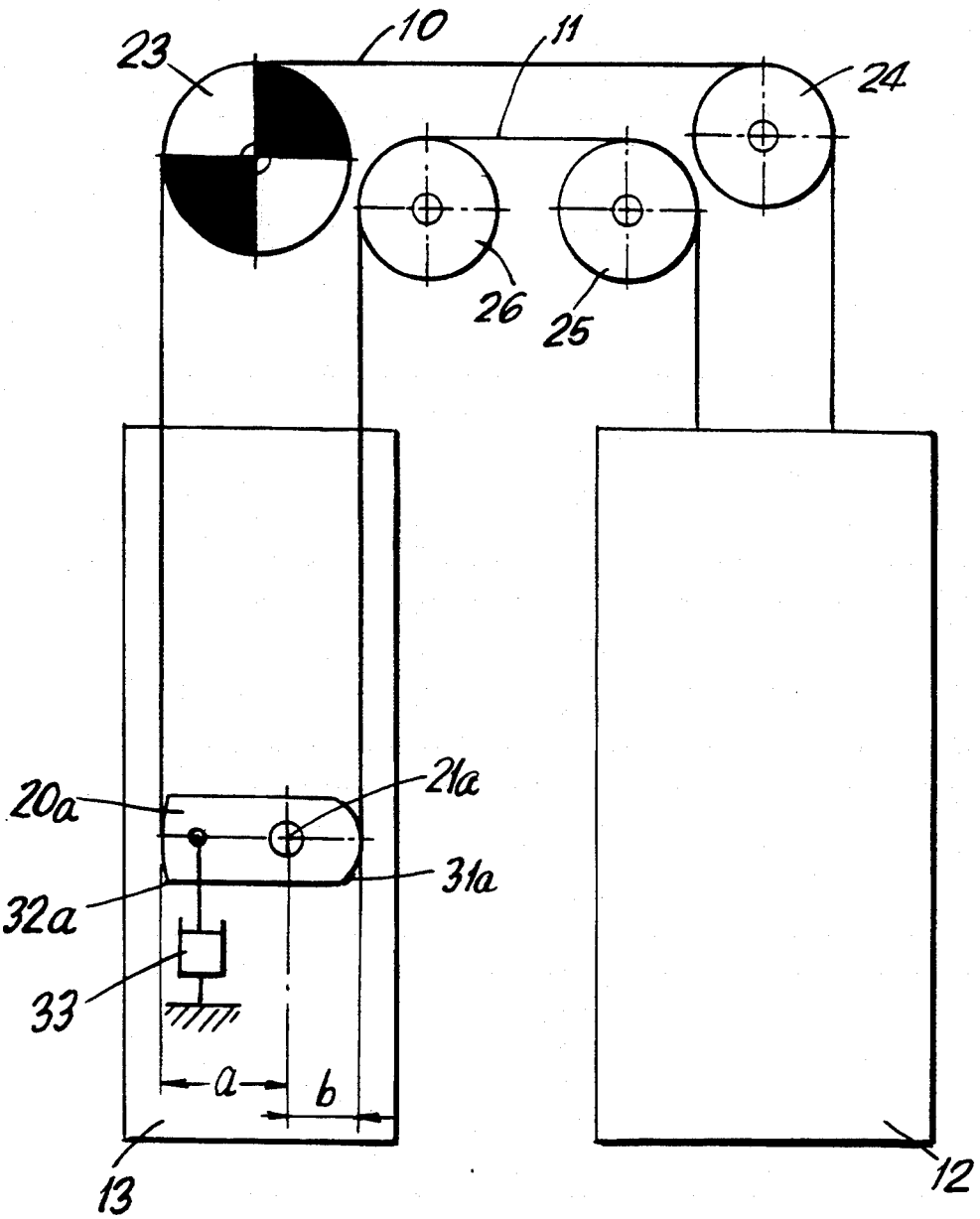
FIG. 4*a* is a diagram of a ninth embodiment of a cable tensioning system of the invention.
Figure 4B:
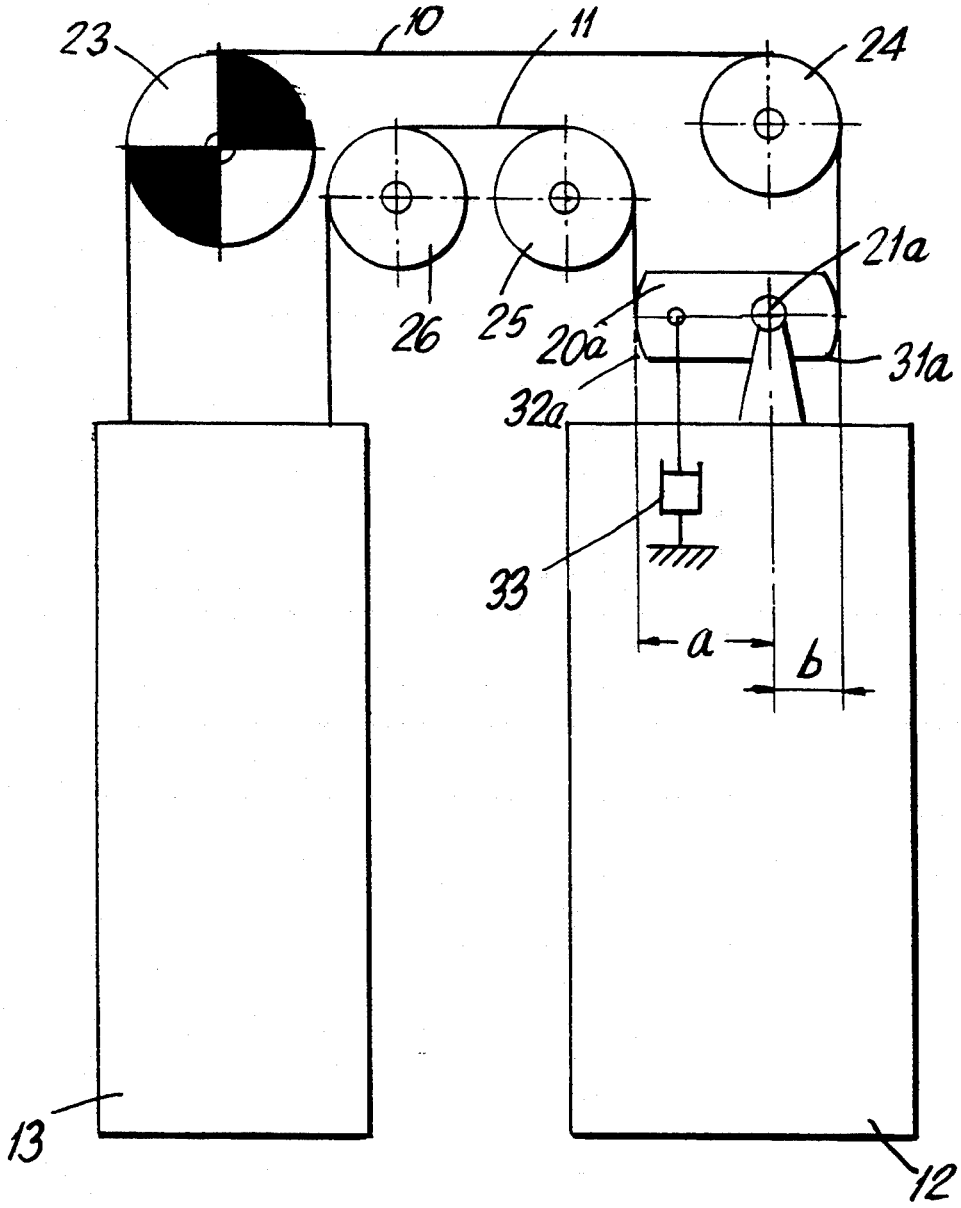
FIG. 4*b* is a diagram of tenth embodiment of the cable tensioning system of the invention.

The embodiments shown in FIGS. 4*a* and 4*b* are similar to those of FIGS. 3 and 3*a*, respectively but show additionally a damping element 33*b* and 33*c*, respectively, for rockers 20*b* and 20*c*.

All the embodiment types of the cable tensioning systems in the invention described and shown in FIGS. 1 to 4 have the advantage, that the lever ratio directly defines the cable tension or pull ratio required for the driving capacity and that said ratio is no longer directly affected by the weight of the elevator cab and the counterweight. This enables the use of elevator cabs of lower weight.

In a sensible refinement of the invention it can be provided that the lever ratio a:b in the inventive cable tensioning system is adjustable by an appropriate device, which enables adjustment of the cable tension or pull ratio at the utilization site.

While the invention has been illustrated and described as embodied in a cable tensioning device, it is not intended to be limited to the details shown, since various modifications and structural changes may be made without departing in any way from the spirit of the present invention.

Without further analysis, the foregoing wilt so fully reveal the gist of the present invention that others can, by applying current knowledge, readily adapt it for various applications without omitting features that, from the stancepoint of prior art, fairly constitute essential characteristics of the generic or specific aspects of this invention.

What is claimed as new and desired to be protected by letters patent is set forth in the appended claims.

1. A cable tensioning system for elevators including an elevator cabin, a counterweight, drive and support cables connecting the elevator cabin and the counterweight, and a drive mechanism including a drive disc for driving the drive cable and located above the elevator cabin, said cable tensioning system comprising:

a support point attached to one of said elevator cabin and said counterweight; and a rocker attached at said support point and having a first attachment point, at which the support cable is attached, and a second attachment point, at which the drive cable is attached, said first and second attachment points being horizontally spaced from said support point a first distance and a second distance, respectively, a ratio of the second distance to the first distance defining a force ratio required for maintaining driving ability of the drive cable, wherein said rocker is configured as a two-sided lever, said support point being attached between said first and second attachment points, and said drive cable extending upward from said rocker.

2. A cable tensioning system according to claim 1, wherein said first attachment point is located on a first peripheral section of said rocker and said second attachment point is located on a second peripheral section of said rocker said first and second peripheral sections being arc-shaped and having radii corresponding to said first and second distances.

3. A cable tensioning system according to claim 2, wherein said rocker has an element for damping rotational movements of said rocker.

4. A cable tensioning system according to claim 2, wherein the ratio of said first and second distances is adjustable.

* * * * *